United States Patent [19]

Follows

[11] 4,428,605

[45] Jan. 31, 1984

[54] LATCHING DROP LOCK FOR SLIDING CLOSURE MEMBER

[75] Inventor: James S. Follows, Surrey, Canada

[73] Assignee: Vanguard Plastics Ltd., Surrey, Canada

[21] Appl. No.: 364,493

[22] Filed: Apr. 1, 1982

[51] Int. Cl.[3] ..... E05C 1/10

[52] U.S. Cl. ..... 292/152; 292/DIG. 46

[58] Field of Search ..... 292/153, 152, 180, 189, 292/DIG. 46

[56] References Cited

U.S. PATENT DOCUMENTS

| | | | |
|---|---|---|---|
| 687,032 | 11/1901 | Karrenberg | 292/152 |
| 1,570,072 | 1/1926 | Merz et al. | 292/152 |
| 4,268,074 | 5/1981 | Alexander | 292/153 X |

FOREIGN PATENT DOCUMENTS

| | | | |
|---|---|---|---|
| 2467277 | 5/1981 | France | 292/152 |

*Primary Examiner*—Richard E. Moore

*Attorney, Agent, or Firm*—Christensen, O'Connor, Johnson & Kindness

[57] ABSTRACT

A latching drop lock for a movable closure member such as a sliding glass window includes a lock body that supports a pivotably mounted, elongated latch element. The lock body and the latch element are slidable as a unit along one side of the movable frame and are slidably engaged in a peripheral channel thereof. The lock body includes a lock bolt element that is insertable in an aperture in the fixed frame to secure the sliding window in a closed position. The elongated latch element includes at one end a detent that is fixedly engageable with the window frame to secure the drop lock in the locked position. The latch element further includes an integral resilient bias spring that urges the lock element rotated about its pivot axis so as to engage the detent whenever the drop lock is slid to the locked position. The latch element further includes manually depressible means operable to disengage the detent and unlatch the drop lock. Two separate motions are required to unlatch and unlock the sliding window, namely, depression of the depressible means and simultaneous upward sliding of the drop lock assembly, thereby reducing the drop lock relatively invulnerable to tampering and picking.

6 Claims, 6 Drawing Figures

LATCHING DROP LOCK FOR SLIDING CLOSURE MEMBER

BACKGROUND OF THE INVENTION

The present invention is generally related to lock assemblies for sliding closure members and, more particularly, to drop lock assemblies for sliding glass windows and doors. Although the invention is applicable to sliding closure members in general, including both doors and windows, the invention will be described below primarily with reference to conventional sliding windows of extruded aluminum frame construction.

Sliding windows are sometimes provided with a device known as a drop lock, which is slidably mounted on one edge of a movable window frame and which includes a downwardly projecting lock bolt that is insertable in one or more holes in the window sill. To lock the sliding window, the drop lock is typically mounted on a vertical side of the frame and slid downwardly to engage the lock bolt in a hole so as to prevent sliding movement of the window.

Previously available drop locks for sliding windows have proven unsatisfactory for various reasons. Some such locks cannot be retrofitted onto preexisting window frames without modification of the frames. Other drop locks have no provision for being secured in their locked position, with the result that they are subject to tampering and picking with any suitable device, for example, a stiff wire, that may be used to engage the drop lock and lift it upwardly from its locked position. Some drop locks include locking devices, for example, set screws, but such devices must typically be actuated separately and independently from the sliding motion of the drop lock, such that the drop lock is frequently left inadvertently in a locked but unlatched position.

Accordingly, it is the object of the present invention to provide an improved drop lock for a sliding closure member, particularly a sliding window or door.

More particularly, it is an object of the present invention to provide a latching drop lock for a sliding window or door. In this regard, it is another object of the invention to provide a latching drop lock that is easy to unlock and yet which is secure against tampering or picking while locked.

It is another object of the present invention to provide a locking drop lock that can be retrofitted onto preexisting extruded aluminum window frames. More particularly, it is an object to provide such a lock that may be retrofitted onto sliding window frames of the type ordinarily mounted on rollers for sliding motion.

It is yet another object of the invention to provide a drop lock that is automatically latched against unlocking movement each time it is lowered to its locked position.

SUMMARY OF THE INVENTION

In accordance with the present invention, there is provided a latching drop lock for a sliding closure member, such as a sliding window or door. The drop lock is particularly adapted to a sliding window having a window frame with an outwardly opening peripheral channel. Many preexisting sliding glass windows have such channels, making the drop lock easily retrofittable onto such windows.

The drop lock includes a lock body that is mounted upon one side member of the movable window frame for sliding movement lengthwise of such member in a direction transverse to sliding movement of the window itself. Extending from the lock body parallel to the frame member is a lock bolt element that is insertable in one or more holes formed in the bottom track member of the fixed window opening frame. When the lock bolt element is so inserted, the lock body and the lock bolt element lock the sliding window in position.

The lock body carries an elongated latch element. The latch element is mounted in the lock body for pivotal motion about a pivot axis extending transversely to the plane of the window frame and also transversely to the direction of travel of the lock body along the frame channel. The latch element includes a detent that is engageable with the movable window frame to secure the lock body in position when the lock bolt is inserted in a receiving hole in the fixed frame. A spring-bias means urges the latch element about its pivot axis so as to engage the latch element detent with the movable window frame when the drop lock is moved to its locked position. Ordinarily, the detent will operate to engage a corner of the window frame formed by the intersection of the inner webs of the outwardly opening peripheral channels mentioned above.

In a preferred embodiment, the latch element is an elongate member pivotably mounted at its midsection and having the detent formed at one end. The opposite, upper end of the elongate member forms a lever arm that protrudes through a cooperable opening in the lock body. Further, the elongate latch element includes an integrally formed, resilient bias spring element that extends from the upper end of the latch element and which slidably engages the channel of the window frame so as to urge the upper end outwardly from the window frame and thereby urge the detent toward the window frame so as to engage the corner of the window frame whenever the lock assembly is moved to the locked position. In such a preferred embodiment, a small portion of the upper end of the latch element protrudes through a cooperable opening in the lock body. To unlatch the drop lock, the protruding portion of the upper end of the latch element must be depressed and the entire drop lock simultaneously raised along the channel of the window frame. Thus, two separate and independent motions must be executed to unlatch and unlock the drop lock. This complexity of execution renders the drop lock relatively secure against tampering and picking.

These and other aspects and advantages of the invention will become apparent on consideration of the following detailed description of a preferred embodiment and the accompanying drawings.

DETAILED DESCRIPTION OF THE PREFERRED EMBODIMENT

Figure 1:
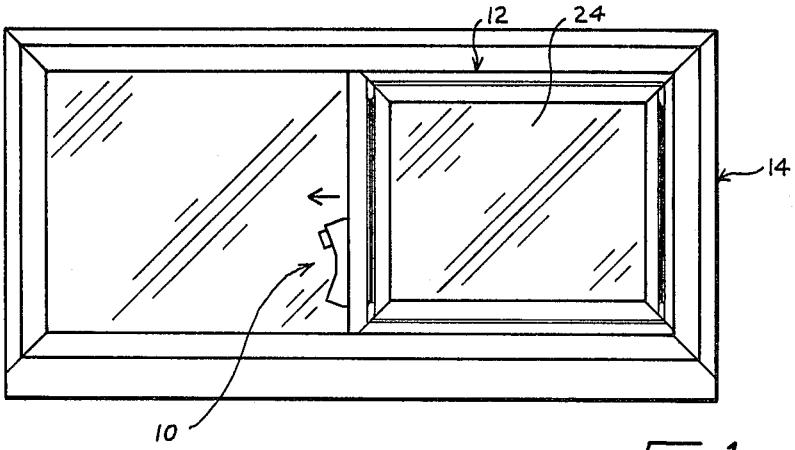
FIG. 1 is a side elevation view of a sliding glass window assembly equipped with a preferred embodiment of the latching drop lock of the present invention.
Figure 2:
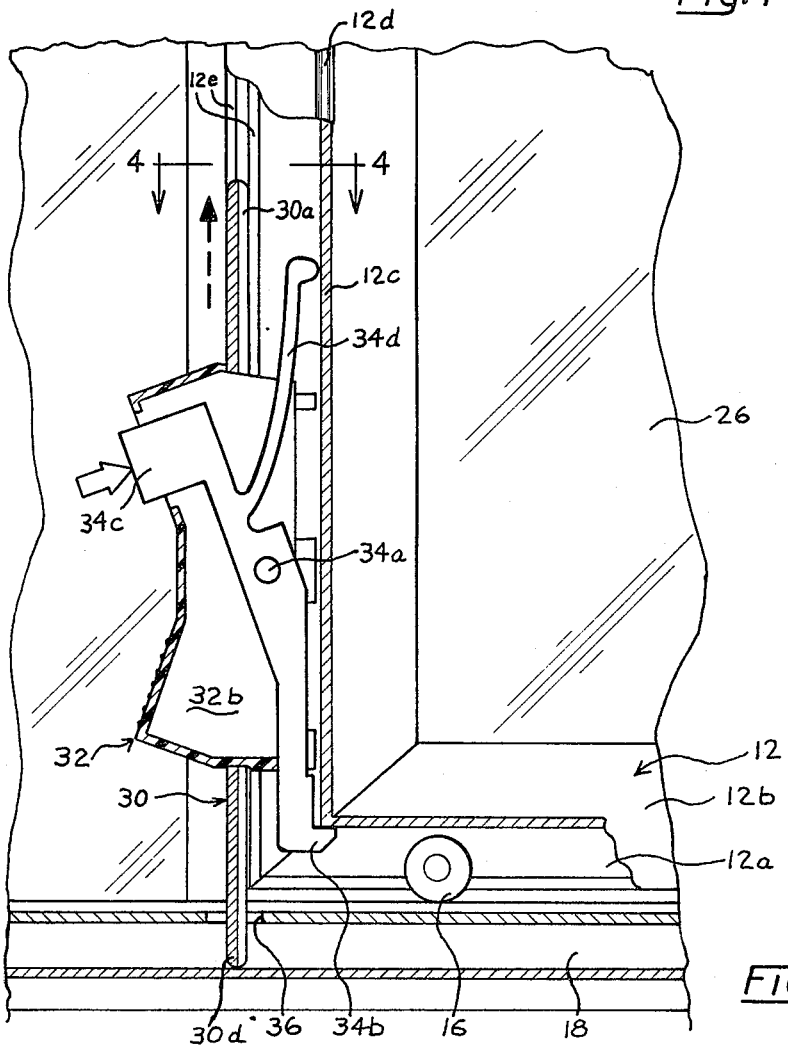
FIG. 2 is an enlarged fragmentary side view partly in cross section showing the latching drop lock of FIG. 1 in its locked position.

In FIG. 1, the latching drop lock 10 is slidably mounted on a movable window frame 12. The movable window frame 12 is slidable in a fixed frame 14 between a closed position, as shown in FIG. 1, and various open positions (not shown). As discussed in further detail below, the drop lock 10, mounted on the left-hand side of the movable frame 12, as seen in FIG. 1, is slidable up and down between a lower, locked position shown in FIGS. 1 and 2, and an upraised, unlocked position, as shown, for example, in FIG. 3.

Referring now to FIGS. 2 through 5, the movable frame 12 is supported by and travels on a set of rollers 16 which ride on a lower guide sill 18 of the fixed frame 14. Referring particularly to the cross-sectional view in FIG. 4, the movable frame 12 is formed of extruded aluminum and is generally H-shaped in configuration, including a pair of parallel flange members 12*a* and 12*b* that are spanned by an integral web 12*c* so as to form an outwardly opening peripheral channel 20 and an inwardly opening channel 22. (In this discussion, the terms "outer" and "outwardly", and "inner" and "inwardly", are used with reference to the center of the movable frame 12.) The movable frame 12 further includes a projective handle 12*d* on member 12*b*.

The movable frame 12 in the example surrounds and supports a pair of windowpanes 24 and 26 set into an elastomeric weatherstrip molding 27 received in the inwardly opening channel 22. The windowpanes 24 and 26 are separated by a desiccant device 28 for removing moisture from between the windowpanes 24 and 26.

Formed at the outer edges of the wall members 12*a* and 12*b* are integral, opposing pairs of track elements 12*e* and 12*f*, respectively. The track elements 12*e* and 12*f* form longitudinal tracks that extend parallel to the frame 12. Thus, on the upright left-hand side of the movable frame 12 there is formed a pair of upright, opposing tracks which open into the peripheral channel 20. These tracks engage and guide the latching drop lock 10, as more fully described below.

Figure 6:
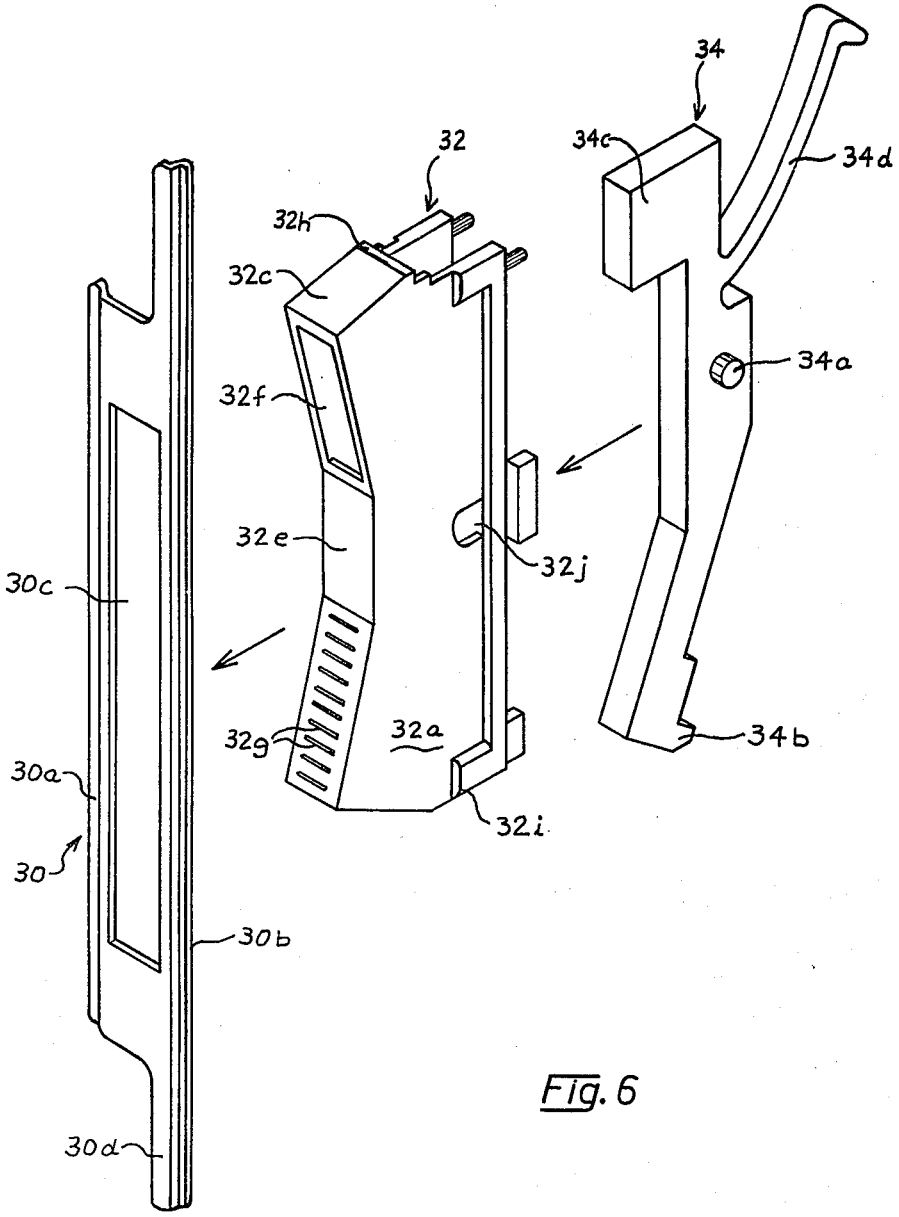
FIG. 6 is an exploded isometric view of the illustrated latching drop lock.

As shown in FIG. 6, the latching drop lock 10 is formed in three parts: an elongated metal slide plate 30, a housing 32, and an elongated latch element 34. Formed along the longitudinal edges of the slide plate 30 are a pair of offset edge portions 30*a* and 30*b* that are slidably engageable respectively in the opposing tracks formed by the track elements 12*e* and 12*f* of the movable frame 12. The slide plate 30 also includes a rectangular opening 30*c* in which the housing 32 is received. The slide plate 30 further includes, at its lower end, an integral, downwardly protruding lock bolt element 30*d* that is insertable in a hole 36 formed in the sill 18 of the window frame 14. The slide plate 30 is mounted to be freely slidable up and down along the left-hand side of the movable frame 12, subject to the operation of the latch element 34 as discussed further below.

The housing 32 is a single-piece unit formed of a molded plastic material and consists generally of parallel sidewalls 32*a* and 32*b*, upper and lower end walls 32*c* and 32*d*, and a front sidewall 32*e* that is formed in three segments. An opening 32*f* is formed in the upper segment of the sidewall 32*e* for receiving a portion of the latch element 34, as discussed further below. The lower segment of the front sidewall 32*e* includes serrations 32*g* formed in its exterior surface to facilitate pushing downward on the drop lock. The housing 32 is open along the side opposite the front sidewall 32*e*.

The housing 32 further includes detent elements 32*h* and 32*i* formed at the inner ends of the upper and lower end walls 32*c* and 32*d*, respectively. The detent elements 32*h* and 32*i* are sufficiently deflectable to permit the housing 32 to be inserted through the opening 30*c* of the slide plate 30 and to thereafter securely retain the housing 32 in the slide plate 30. The housing 32 further includes a pair of opposing apertures 32*j* formed in the sidewalls 32*a* and 32*b*, for purposes that will be apparent from the following discussion of the latch element 34.

The latch element 34 is an elongated member having a pair of integral coaxial pivot pins 34*a* extending transversely in opposite directions from its midsection. The pivot pins 34*a* are ordinarily received in the apertures 32*j* of the housing 32. The lower end of the latch element 34, as viewed in FIG. 5, includes a right-angle detent 34*b*. With the drop lock installed and assembled on the movable frame 12, the detent 34*b* is ordinarily positioned against the outer surface of the web 12*c* of the movable frame 12.

The upper end of the latch element 34 includes a right-angle extension portion 34*c* that ordinarily protrudes through the opening 32*f* of the housing 32. The upper end of the latch element 34 further includes an integral resilient bias spring element 34*d* that extends upwardly at an acute angle with respect to the latch element 34 from the side opposite the right-angle extension portion 34*c*. As discussed further below, the bias spring element 34*d* operates to maintain the latch element 34 urged about the axis of the pivot pins 34*a*.

Figure 3:
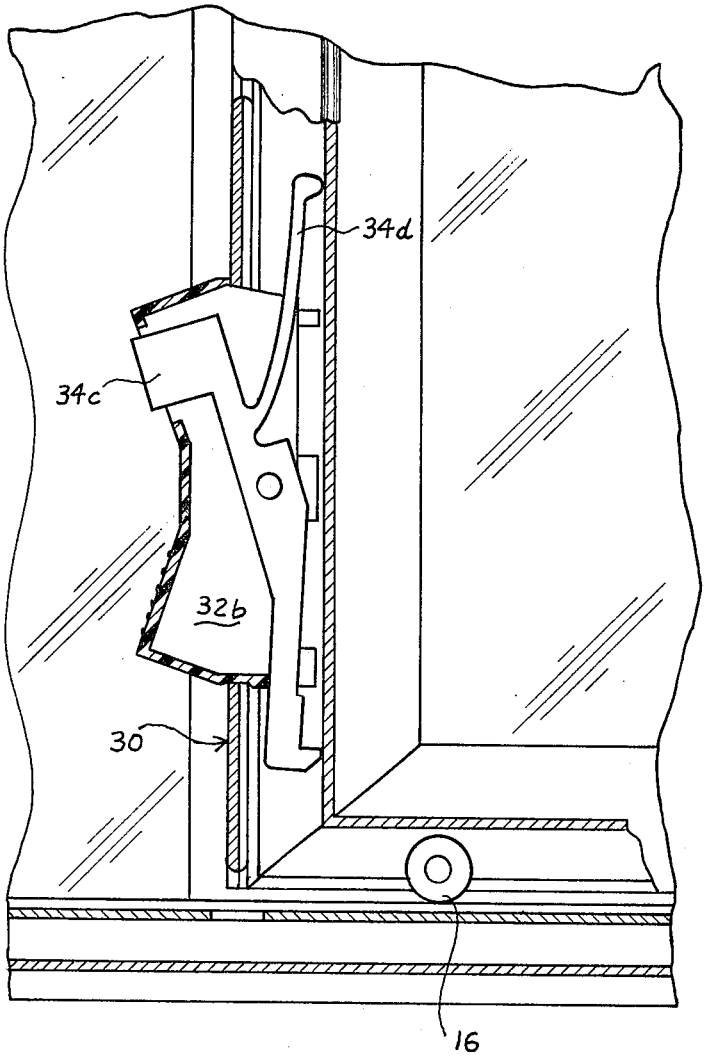
FIG. 3 is similar to FIG. 2, with the drop lock shown in an unlocked position.
Figure 4:
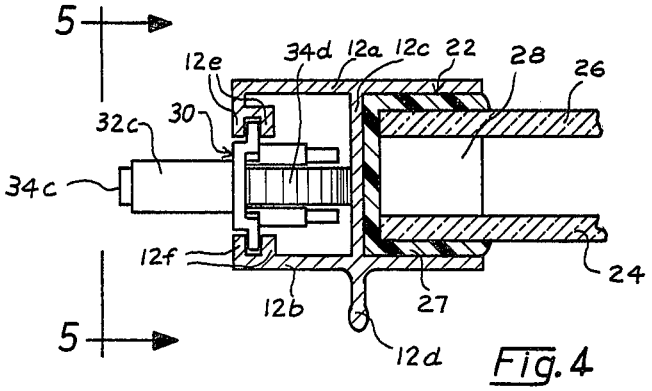
FIG. 4 is a fragmentary sectional top view illustrating the latching drop lock of FIG. 1, taken along section line 4—4 in FIG. 2.
Figure 5:
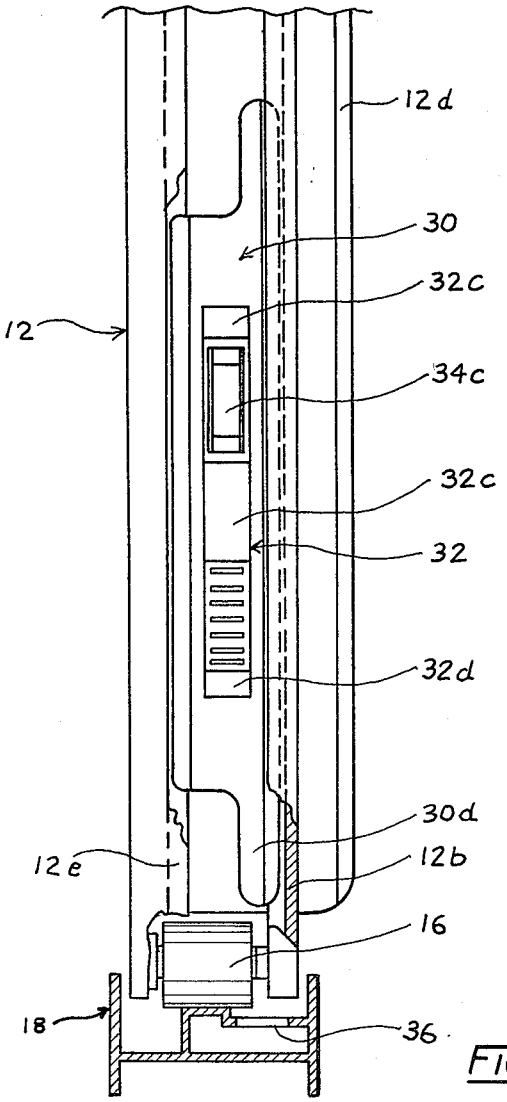
FIG. 5 is an edge view of the lower portion of the window and its underlying guide track illustrating the drop lock in upraised unlocked position, with a portion of the track member and frame broken away and shown in sections.

Referring now once again to FIG. 2, the assembled drop lock 10 is ordinarily slidable up and down along the left-hand side of the movable frame 12, with the parallel offset sides 30*a* and 30*b* of the slide plate 30 slidably engaged in the opposing tracks formed by track elements 12*e* and 12*d* of the H-shaped frame 12. When so installed, the bias spring element 34*d* is slidably urged against the outer surface of the channel web 12*c* so as to urge the upper end of the latch element 34 outwardly, or counterclockwise, about its pivot pins 34*a*, as viewed in FIG. 2. Thus, with the drop lock 10 raised to an unlocked position, as shown in FIG. 3, the spring bias element 34*d* urges the upper end of the latch element 34 outwardly, or in a counterclockwise direction, about the pivot pin 34*a*, such that the extension portion 34*c* protrudes through the opening 32*f* of the housing 32. In this position, both the bias spring element 34*d* and the detent 34*b* are slidably pressed against the surface of the web 12*c* such that the entire drop lock assembly can be slid up and down along the side of the movable frame 12. When the drop lock 10 is slid downwardly until the lock bolt element 30*d* is inserted in the hole 36 of the lower sill 18, the detent 34*b* of the latch element 34 snaps into place to engage the corner formed by intersecting webs 12*c* of the movable frame 12. In this locked and latched position, the drop lock 10 cannot be raised and the movable frame 12 is thereby locked in position. Only by depressing the extension portion 34*c* of the latch element 34, so as to pivot the latch element 34 about its pivot pins 34*a* and thereby remove the detent 34*b* from the corner of the intersecting webs 12*c*, can the drop lock 10 be raised upwardly to unlock the movable window frame 12. It will be appreciated that two simultaneous motions must be executed, namely, depressing of the extension portion 34c of the latch element 34 and simultaneously lifting the entire drop lock 10 upwardly. This combination of motions renders the drop lock 10 particularly invulnerable to tampering and picking of the type normally attempted by a person using a stiff wire, rod, or other device inserted through gaps in the window from outside the building.

It will be appreciated that the drop lock is automatically latched in place each time it is lowered to the locked position. This prevents the drop lock from being inadvertently left in a locked but unlatched position.

Although the present invention is described and illustrated with reference to its preferred embodiment, it will be understood that various modifications, alterations, and substitutions may be made without departing from the essential spirit of the invention. Accordingly, the scope of the invention is defined by the following claims.

The embodiments of the invention in which an exclusive property or privilege is claimed are defined as follows:

1. A latching drop lock for a slidable closure member mounted for sliding movement in a fixed frame structure, said drop lock comprising:

lock body means slidably mountable on said closure member for sliding movement in a direction transverse to the direction of sliding movement of said closure member, said lock body means including a lock bolt member extending therefrom in a direction generally parallel to the direction of sliding movement of said lock body means; and an elongated latch element pivotably attached to and received in said lock body means for rotation about a pivot axis oriented to extend transversely with respect to the direction of travel of said lock body means, said latch element having first and second ends, said first end including a detent for engaging fixed structure of the closure member so as to latch said drop lock in a locked position wherein said lock bolt member protrudes into a cooperable receiving aperture formed in said fixed frame structure to thereby secure said closure member against sliding movement, said second end of said latch element being manually actuatable to pivot said latch element about its pivot axis and thereby release said latch element from locking engagement with said closure member, and bias spring means coupled to said latch element for urging said first end away from said closure member about said pivot axis so as to maintain said latch element in locking engagement with the said latch element in said locked position.

2. The latching drop lock claimed in claim 1 wherein said bias spring means comprises a resilient deflectable spring element formed integrally with said latch element, said spring element extending from said second end of said latch element so as to be slidably urged in compression against said closure member.

3. The latching drop lock claimed in claim 1 wherein said lock body means comprises a lock housing and an elongate slide plate, said slide plate being adapted to be received in sliding engagement in an outer peripheral channel of a movable closure frame, said lock bolt member being an integral extension of said slide plate, said slide plate including a central elongate opening in which said lock housing is retentively secured.

4. The locking drop lock claimed in claim 3 wherein said latch element includes integrally formed transversely extending pivot pins journalled in respective opposing apertures formed in side plates of said lock body housing, and wherein a portion of said second end of said latch element extends through an opening in said lock body housing to form a manually depressible latch release means, whereby unlatching of said closure member is effected by depressing said release means and simultaneously sliding the drop lock away from said locked position.

5. The latching drop lock defined in claim 4 wherein said bias spring means includes an integral resilient spring element extending from said second end of said latch element, said spring element being slidably urged in compression against said closure member so as to urge said first end of said latch element outwardly away from said closure member.

6. The latching drop lock defined in claim 5 wherein said slide plate is adapted for mounting in sliding engagement in an outwardly opening peripheral channel of a closure frame, and wherein said detent of said latch element engages one corner of said closure frame.

* * * * *